US006604517B1

(12) United States Patent
Chao et al.

(10) Patent No.: US 6,604,517 B1
(45) Date of Patent: Aug. 12, 2003

(54) TABLE TENNIS SERVING MACHINE

(76) Inventors: Tsung-Chih Chao, 6th Fl., No. 13, Lane 15, Min-Tsu Rd., Nan-Kang-Li, Chang Hua City (TW); Teng-Lu Tsai, No. 22, Lane 20, Tzu-Chiang St., E. Dist., Taichung City (TW); Thomas Donald Hugar, 25002 El Cortijo, Mission Viejo, CA (US) 92691

( * ) Notice: Subject to any disclaimer, the term of this patent is extended or adjusted under 35 U.S.C. 154(b) by 0 days.

(21) Appl. No.: 10/162,052

(22) Filed: Jun. 5, 2002

(51) Int. Cl.[7] ..... F41B 7/00
(52) U.S. Cl. ..... 124/16; 124/39; 124/51.1
(58) Field of Search ..... 124/16, 37, 39, 124/48, 51.1, 82

(56) References Cited

U.S. PATENT DOCUMENTS 3,084,680 A * 4/1963 Goldfarb et al.
3,807,379 A * 4/1974 Vodinh
5,888,155 A * 3/1999 Lee ..... 124/16 X
6,176,230 B1 * 1/2001 Thompson ..... 124/16

* cited by examiner

*Primary Examiner*—John A. Ricci
(74) *Attorney, Agent, or Firm*—Harrison & Egbert

(57) ABSTRACT

A table tennis service machine is simple in construction and is formed of mechanical devices, such as a ball feeding device, a driving member, a deceleration gear set, and a ball ejecting device. The deceleration gear set is driven by the driving member such that the ball ejecting device is driven by the deceleration gear set in an intermittent manner, thereby resulting in a periodic ejection of the ball by the service machine.

1 Claim, 10 Drawing Sheets

TABLE TENNIS SERVING MACHINE

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to table tennis equipment, and more particularly to a machine which is designed to serve the table tennis ball.

BACKGROUND OF THE INVENTION

There are a variety of conventional Ping-Pong service machines available in the market place today. These conventional Ping-Pong service machines are composed of many complicated electronic devices and are therefore rather expensive, thereby making them beyond the means of the Ping-Pong enthusiasts in general.

BRIEF SUMMARY OF THE INVENTION

The primary objective of the present invention is to provide a table tennis service machine which is simple in construction and cost-effective, thereby making it affordable to the sporting public.

In keeping with the principle of the present invention, the foregoing objective of the present invention is attained by the table tennis service machine which is designed to serve the table tennis ball by mechanical means rather than electronic means. The machine of the present invention comprises simple mechanical devices, such as drive gear, ball feeding device, deceleration gears, ball ejecting device, etc.

The features and functions of the present invention will be more readily understood upon a thoughtful deliberation of the following detailed description of the present invention with reference to the accompanying drawings.

DETAILED DESCRIPTION OF THE INVENTION

Figure 1:
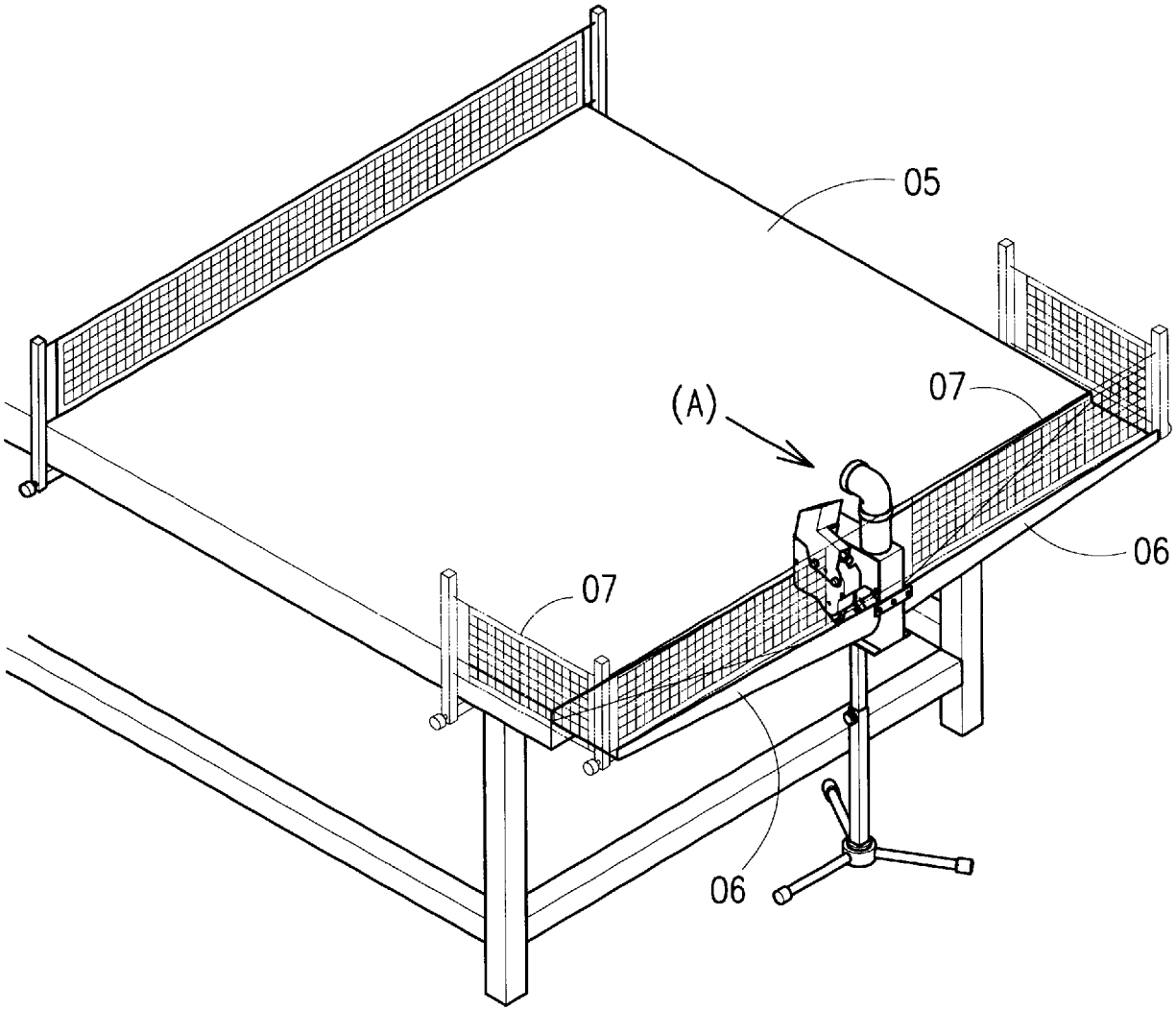
FIG. 1 shows a schematic view of the present invention in use.
Figure 2:
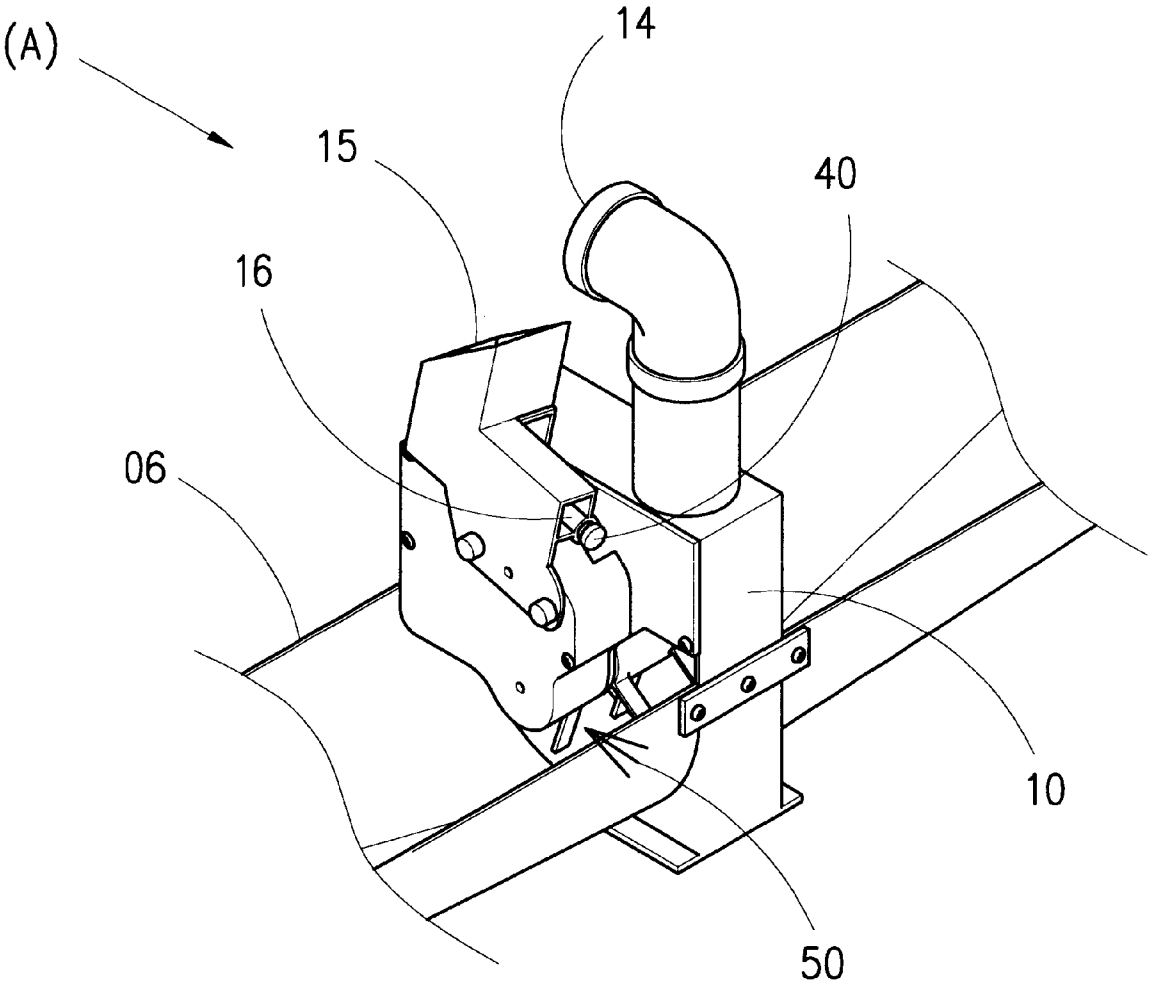
FIG. 2 shows a perspective view of the present invention.
Figure 3:
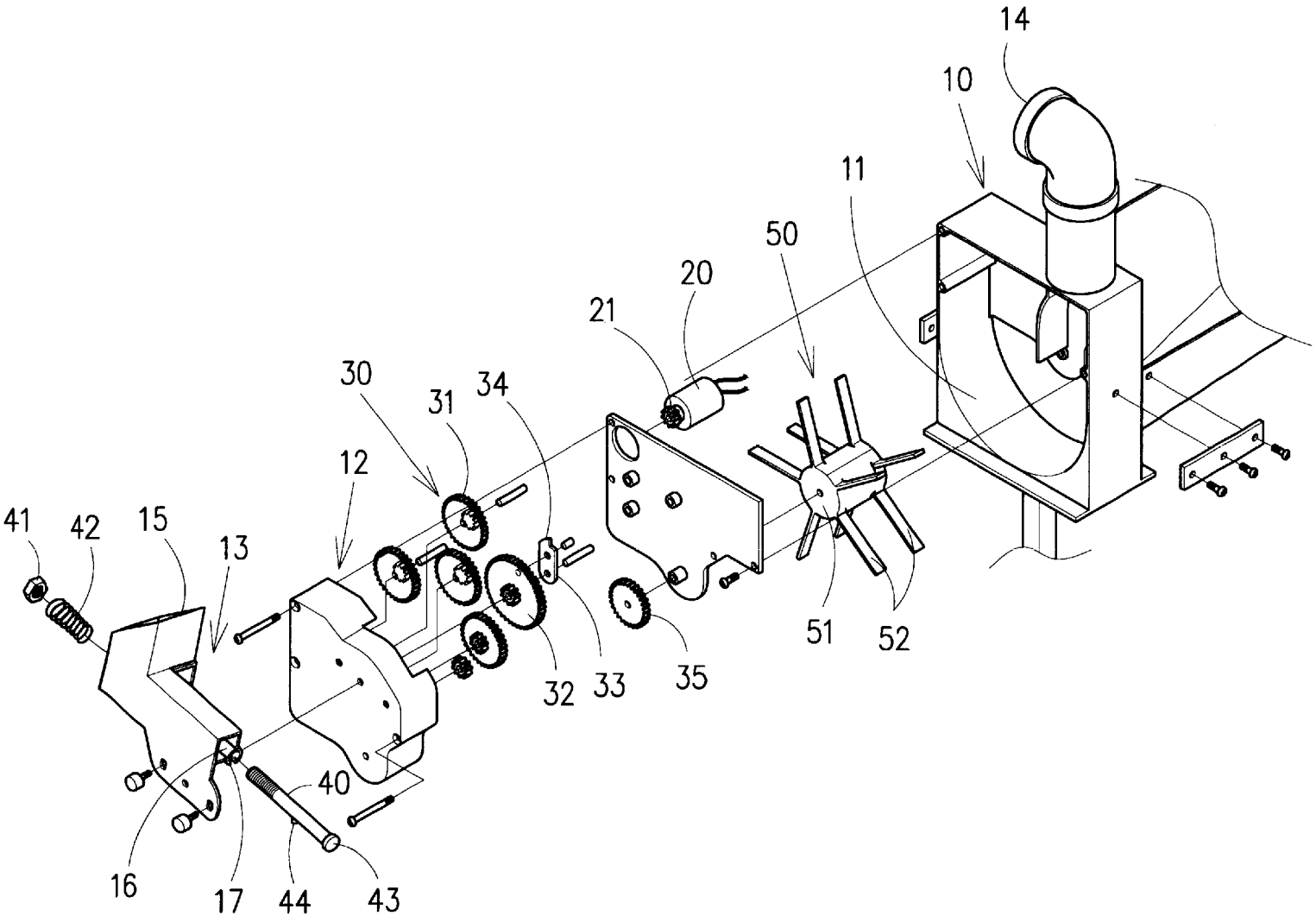
FIG. 3 shows an exploded perspective view of the present invention.
Figure 4:
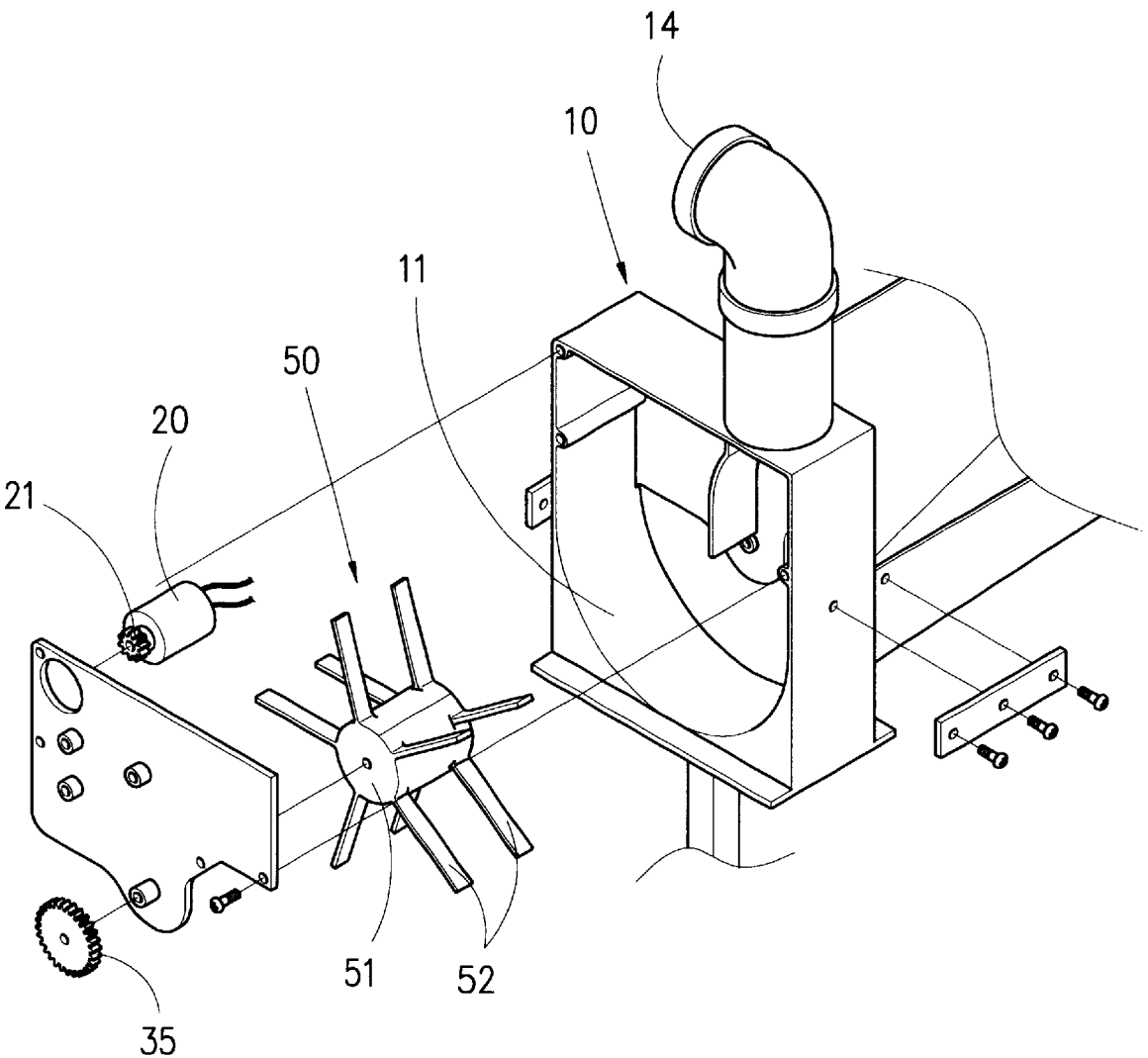
FIG. 4 shows a partial enlarged exploded view of the present invention.
Figure 5:
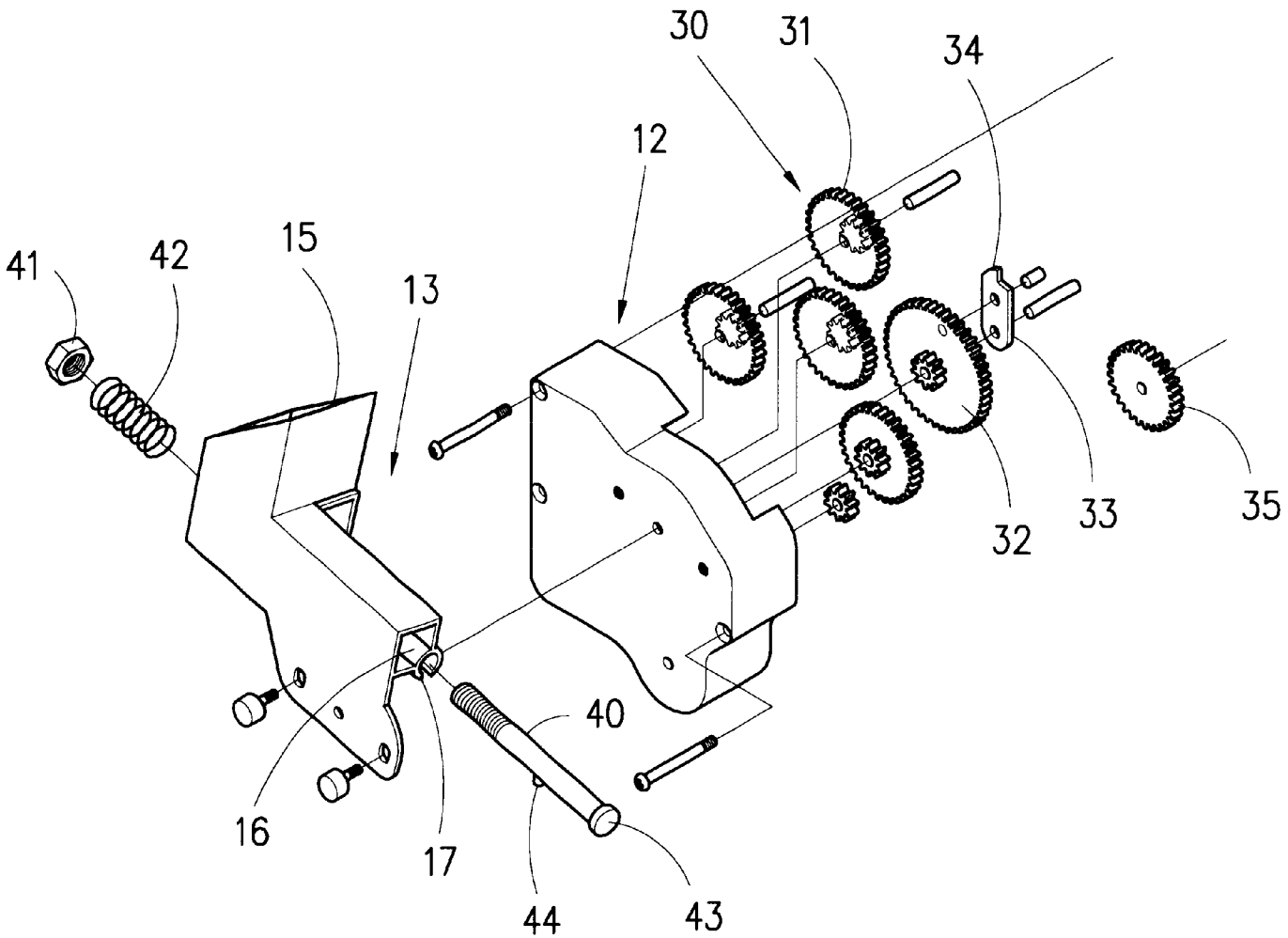
FIG. 5 shows another partial enlarged exploded view of the present invention.

As shown in FIG. 1, a table tennis service machine "A" of the present invention is in use such that it is set up at the opponent end of a Ping-Pong table 05 in conjunction with a ball tray 06 and a net 07.

As shown in FIGS. 2–10, the table tennis service machine "A" of the present invention comprises a housing 10, a drive motor 20, a deceleration gear set 30, a ball ejecting member 40, and a ball feeding member 50.

The housing 10 is provided with a guide slot 11, an assembly slot 12, and an ejection slot 13. The guide slot 11 is provided at the top end with a port 14. The ejection slot 13 is provided at the top end with an opening 15. The assembly slot 12 is located between the guide slot 11 and the ejection slot 13. The ejection slot 13 is provided therein with a guiding tube 16 which is in turn provided with an elongated through slot 17 in communication with the assembly slot 12.

The drive motor 20 is mounted in the assembly slot 12 and is provided with a drive gear 21 which is mounted on an output shaft of the motor 20.

The deceleration gear set 30 is mounted in the assembly slot 12 and is formed of a plurality of gears. In other words, the deceleration gear set 30 is formed of a first driven gear 31, and other driven gears 32 and 35. The first driven gear 31 is engaged with the drive gear 21 of the motor 20. The driven gear 32 is fastened with a push plate 33 which is provided at the top end with a protrusion 34.

The ball ejecting member 40 is a rod greater in length than the guiding tube 16 of the ejection slot 13. The ball ejecting rod 40 is provided at the front end with a threaded portion, and at the rear end with a head 43. The ball ejecting rod 40 is slidably fitted into the guiding tube 16 in conjunction with a spring 42 fitted thereover, and a nut 41 which is engaged with the threaded portion of the front end of the ball ejecting rod 40. The head 43 is stopped by the rear end of the guiding tube 16. The ball ejection rod 40 is further provided on the outer wall of the shank thereof with a projection 44, which juts out of the elongated through slot 17 of the guiding slot 16 such that the projection 44 can be pushed by the protrusion 34 of the plate 33 of the driven gear 32.

The ball feeding member 50 is formed of a shaft 51 and a plurality of arms 52 extending from the shaft 51 at intervals. The ball feeding member 50 is pivoted in the guide slot 11 such that one end of the shaft 51 is fastened with a last driven gear 35 of the deceleration gear set 30.

Figure 6:
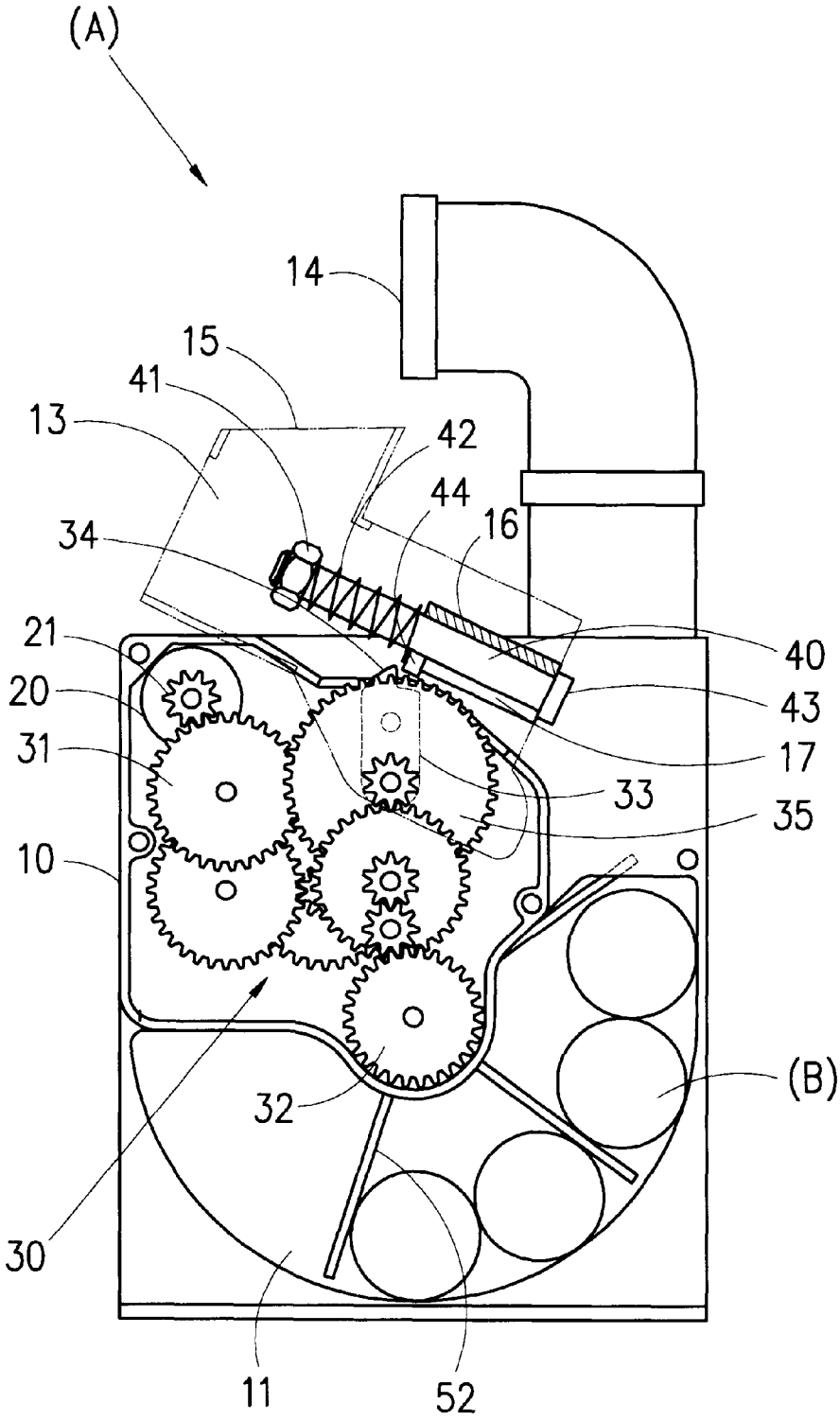
FIGS. 6–10 are sectional views of the present invention in action.
Figure 7:
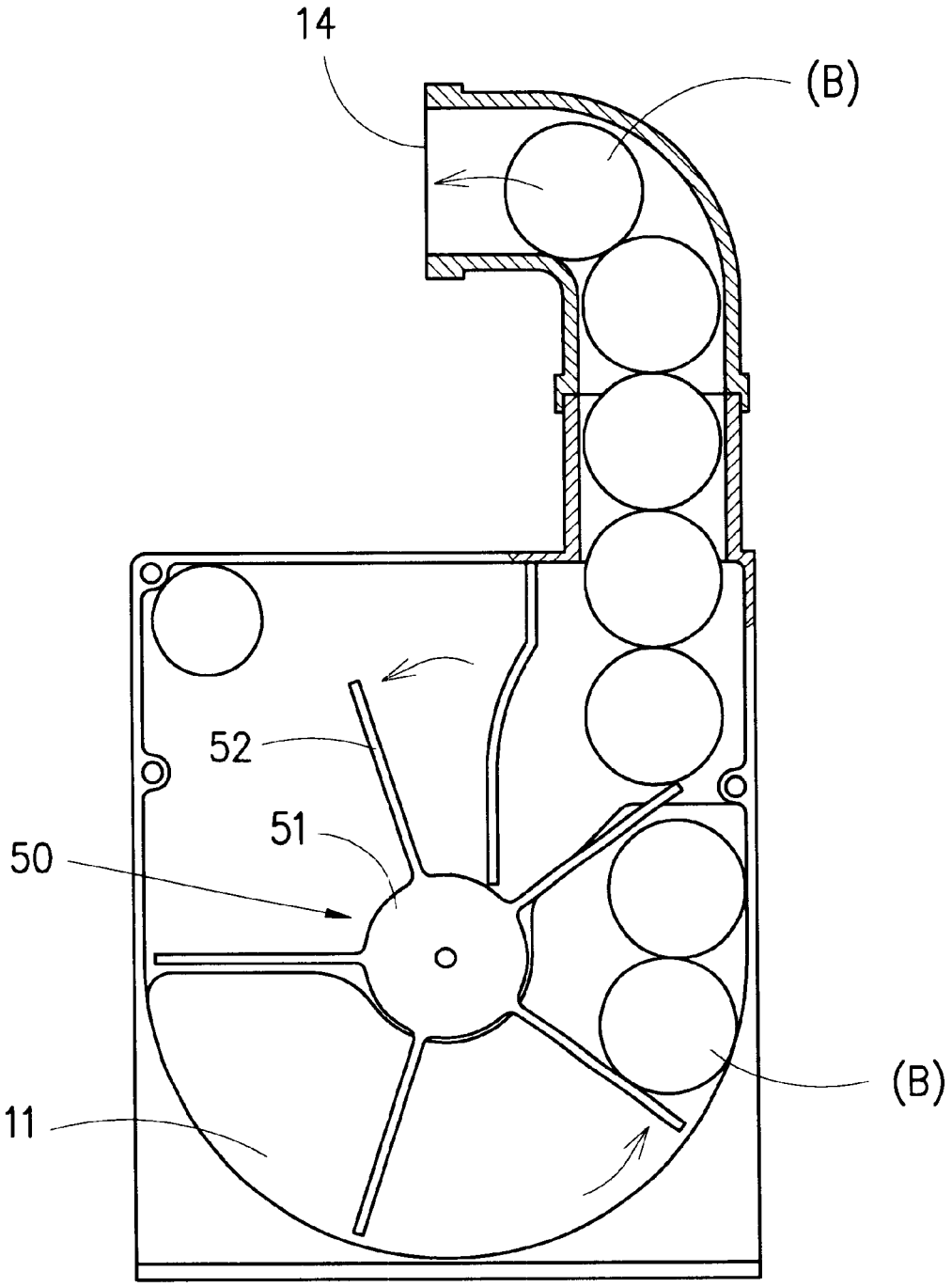
Figure 8:
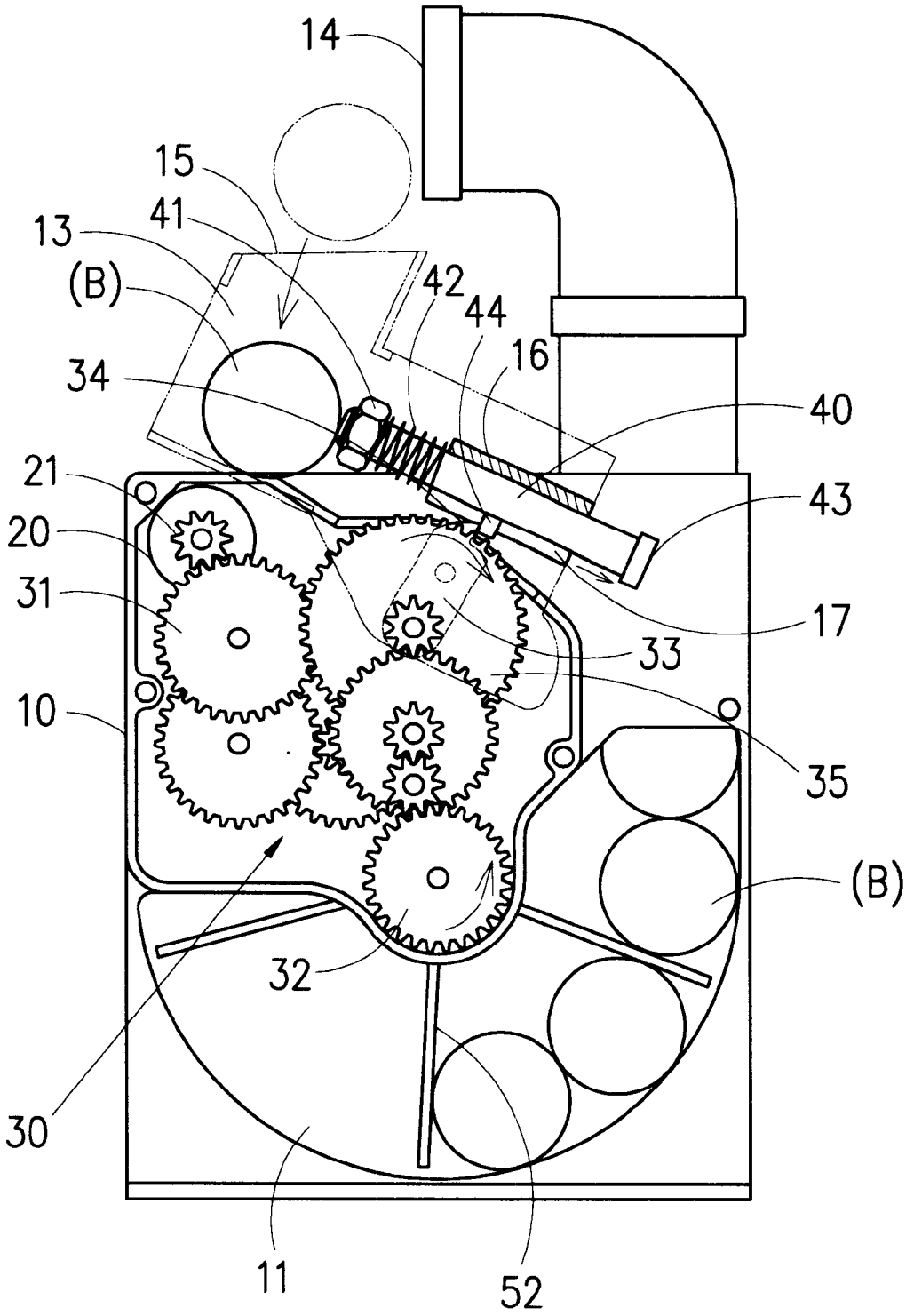
Figure 9:
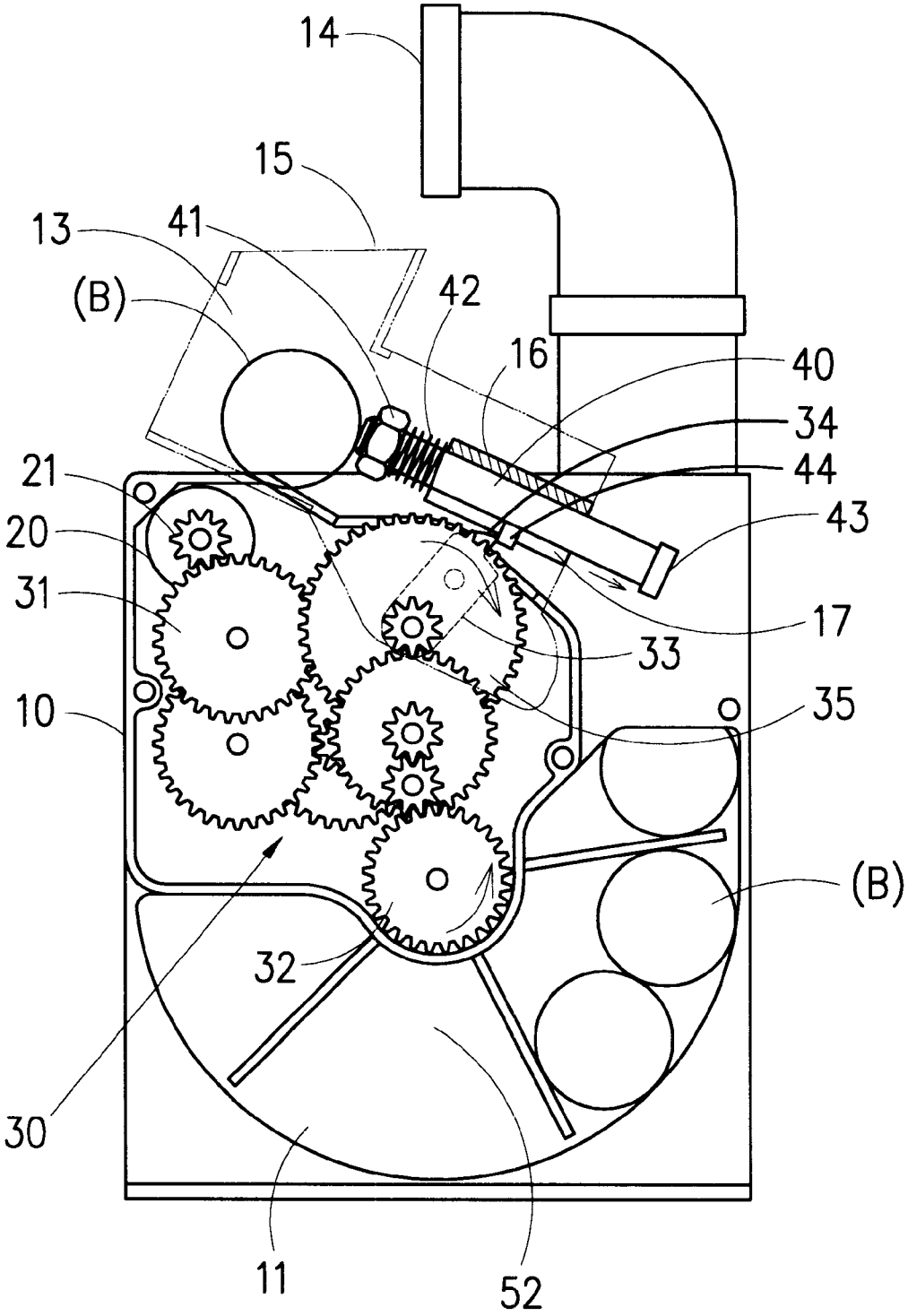
Figure 10:
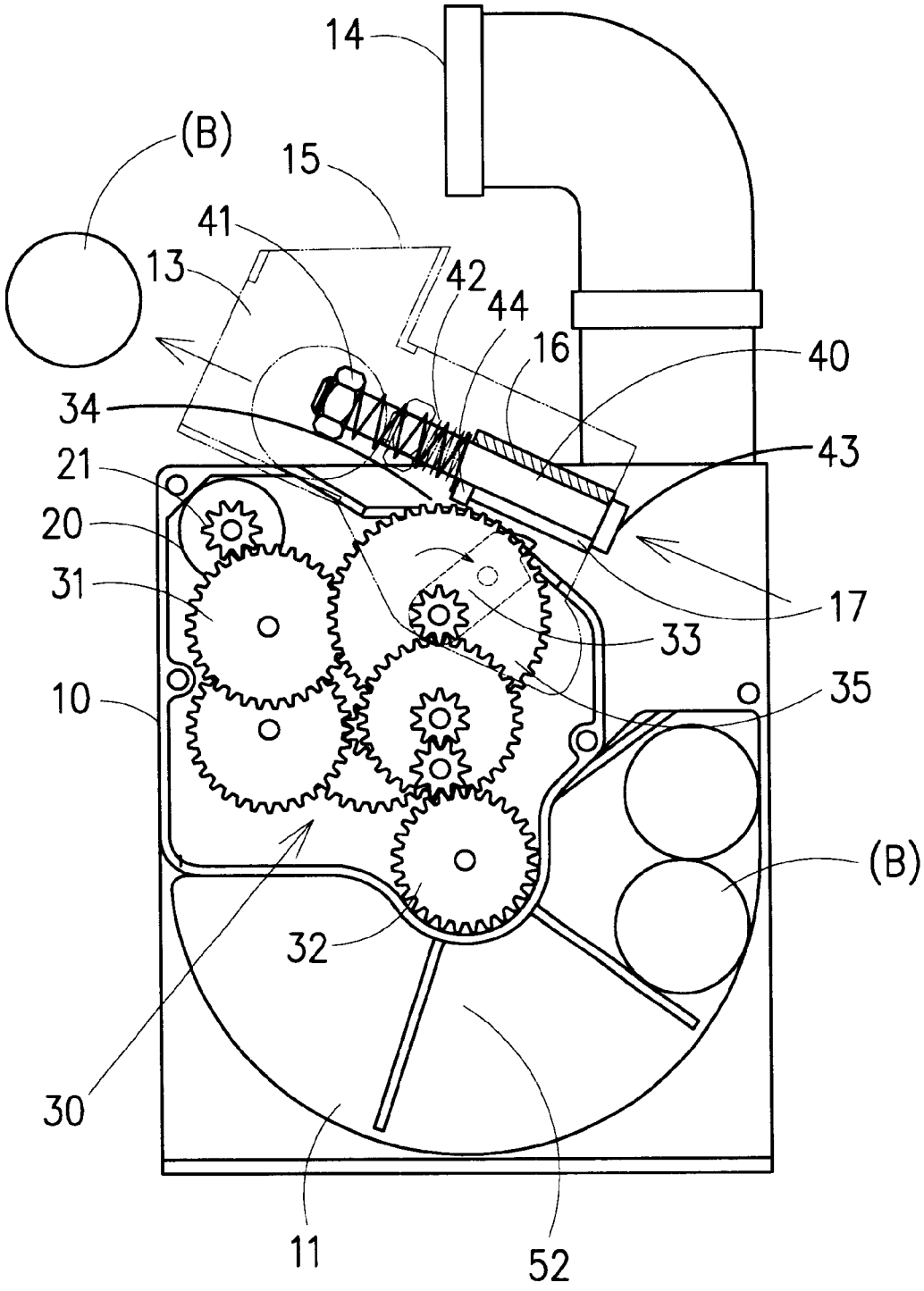

In operation, the drive gear 21 of the motor 20 drives the deceleration gear set 30 such that the ball feeding member 50 is driven to turn by the driven gear 32 of the deceleration gear set 30. As the shaft 51 is turned, the arms 52 of the shaft 51 turn along to scoop up the balls "B" which are located in the tray 06. The balls are eventually pushed to the port 14 of the guide slot 11, as shown in FIGS. 6 and 7. The ball located at the top is pushed out of the port 14 to fall into the ejection slot 13 via the opening 15 which is located under the port 14, as illustrated in FIG. 8. In the meantime, the projection 44 of the ban ejection rod 40 is periodically pushed backward by the protrusion 34 of the plate 33 of the driven gear 32, as shown in FIG. 9. In light of the protrusion 34 of the plate 33 engaging in a circular motion, the projection 44 of the ball ejecting rod 40 is pushed by the protrusion 34 of the plate 33 in an intermittent manner. As a result, when the pushing is paused, the ball "B" is ejected by the ball ejecting rod 40 which is acted on by the spring force of the spring 42, as illustrated in FIG. 10.

We claim:

1. A table tennis service machine comprising:

a housing which is comprised of a guide slot, an assembly slot, and an ejection slot, said guide slot being provided at a top end with a port, said ejection slot being provided at a top end with an opening which is located under said port of said guide slot, said assembly slot being located between said guide slot and said ejection slot whereby said ejection slot is provided with a guiding tube which is provided in a tube wall with an elongated through slot in communication with said assembly slot;

a motor comprising an output shaft, and a drive gear mounted on said output shaft, said motor being mounted in said assembly slot of said housing;

a deceleration gear set mounted in said assembly slot and comprised of a plurality of driven gears, one of which is engaged with said drive gear of said motor, with another one of said driven gears being provided with a push plate which is in turn provided at a top end thereof with a protrusion whereby said protrusion is engaged in a circular motion at the time when said push plate is in motion;

a ball ejecting rod greater in length than said guiding tube of said ejection slot of said housing, said ball ejecting rod being slidably disposed in said guiding tube in conjunction with a spring fitted thereover such that said spring is located between one end of said guiding tube and a nut fastened to one end of said ball ejecting rod, said ball ejection rod provided in an outer wall with a projection whereby said projection juts out of said guiding slot via said elongated through slot of said guiding slot such that said projection is pushed by said protrusion of said push plate in motion to cause said ball ejecting rod to move intermittently in a backward direction, thereby resulting in compression of said spring; and a ball feeding member comprised of a shaft and a plurality of arms extending from said shaft, said ball feeding member being located in said guide slot of said housing such that said shaft is driven by one of said driven gears of said deceleration gear set, and that said arms of said ball feeding member turn along with said shaft in motion to scoop up table tennis balls which are collected in a tray located at an opponent end of a table, with the table tennis balls being lined up in said guide slot such that a ball located at the top is pushed out of said guide slot via said port of said guide slot, so as to fall into said ejection slot via said opening of said ejection slot, thereby resulting in ejection of the ball by said ball ejecting rod in conjunction with a spring force of said spring.

* * * * *